United States Patent [19]

Björkqvist

[11] Patent Number: 4,976,475

[45] Date of Patent: Dec. 11, 1990

[54] KNOCK DOWN SPOOL

[75] Inventor: Markku R. Björkqvist, Värnamo, Sweden

[73] Assignee: AB Varnamo Gummifabrik, Varnamo, Sweden

[21] Appl. No.: 353,416

[22] Filed: May 18, 1989

[30] Foreign Application Priority Data

May 19, 1988 [SE] Sweden ..... 88018783

[51] Int. Cl.[5] ..... B65H 75/22

[52] U.S. Cl. ..... 242/115; 242/116; 242/118.6; 242/118.7; 242/118.4

[58] Field of Search ..... 242/115, 116, 117, 118.6, 242/118.61, 118.4, 118.7, 77–77.4

[56] References Cited

U.S. PATENT DOCUMENTS

| | | | |
|---|---|---|---|
| 2,374,736 | 11/1943 | Cunningham . | |
| 2,605,980 | 12/1947 | Atwood et al. . | |
| 2,957,642 | 10/1960 | Benoit | 242/118.61 |
| 3,822,841 | 7/1974 | Campbell | 242/115 |
| 3,934,767 | 1/1976 | Jones | 242/118.7 X |
| 3,940,085 | 2/1976 | Campbell | 242/115 |
| 3,970,267 | 7/1976 | Sheetz | 242/115 |
| 4,412,661 | 11/1983 | Wise et al. | 242/118.7 X |
| 4,471,919 | 9/1984 | Leunig | 242/115 |

FOREIGN PATENT DOCUMENTS 597083 3/1978 Switzerland .

*Primary Examiner*—Stuart S. Levy
*Assistant Examiner*—Steven M. du Bois
*Attorney, Agent, or Firm*—Pollock, Vande Sande & Priddy

[57] ABSTRACT

A knock down spool includes a substantially cylindrical central member and radially projecting end flanges connected therewith. The central member comprises at least two sections releasably connected with each other in a substantially axial plane. The central member is at its end portions provided with peripheral grooves releasably engaged by engagement portions of the end flanges for maintaining a position in which the end flanges enclose and keep together the sections of the central member.

13 Claims, 3 Drawing Sheets

KNOCK DOWN SPOOL

BACKGROUND OF THE INVENTION

The present invention relates to a spool consisting of a substantially cylindrical central member and radially projecting end flanges connected with the central member.

Spools of this kind have a wide field of application for the winding and storing of seal strip, wire, cord and ribbon of different kinds and for other different purposes. Small spools are usually manufactured from paper or plastic material and have simple and inexpensive, disposable construction, while larger spools have to be of a more rigid and thereby expensive construction. For this reason it is desirable that the larger spools be re-usable which requires that the spools are of a so called knock down construction so that they occupy as little space as possible during storing and transportation. In order to comply with this requirement spools of more or less complicated construction have been developed . A previously known spool comprises a central member consisting of two sections which are releasably connected with each other in an axial plane and end flanges which are releasably connectable with the central member at the end portions thereof in a position in which they enclose and thereby maintain the sections of the central member in an assembled position. A spool of this kind can be disassembled after use and can be stored and transported in a space saving position until it is assembled to be used again for the winding of the desired products.

A drawback of the previously known spools of the knock down type is that the arrangements of the spools used for releasably retaining the end flanges in the position in which they enclose and maintain the sections of the central member in an assembled position are complicated and expensive to manufacture and also restrict the type of constructional material for the spools to materials of high strength and also require a manufacturing including small dimensional variations.

SUMMARY OF THE INVENTION

The object of the present invention is to provide a spool of a knock down type which can be manufactured from inexpensive materials and with large tolerances and at the same time, functions reliably and which can be assembled and disassembled for re-use many times.

In order to comply with this object a spool of the present invention includes a substantially cylindrical central member and radially projecting end flanges connected therewith. The central member comprises at least two sections releasably connected with each other in a substantially axially extending plane and the end flanges enclose and are releasably connected with one end portion each of the central member so as to hold the sections thereof in assembled position. The central member has at its end portions peripheral grooves forming axially as well as radially oriented surface portions releasably engaged by engagement portions of the end flanges for maintaining the position in which the end flanges enclose and hold the sections in assembled position.

The construction of a device for releasably connecting the end flanges with the central member characterizing the spool according to the present invention makes it possible to manufacture the spool from inexpensive material, for example cellular plastics and corrugated cardboard.

In a preferred embodiment of the spool according to the invention the grooves are in the direction of the adjacent end of the central member restricted by radially outwardly directed lugs extending along sections of the periphery of the central member and forming gaps between themselves. The radially inwardly directed lugs of the end flanges are insertable into the grooves through the gaps between the radially outwardly directed lugs of the central member and by rotation of the end flanges in relation to the central member introducable behind the radially outwardly directed lugs of the central member. Thereby it is suitable that the grooves form within the areas of the radially outwardly directed lugs of the central member depressions at their bottoms, which are adapted to receive one end portion each of the radially outwardly directed lugs of the end flanges so as to provide a releasable locking position with regard to rotation of the end flanges in relation to the central member.

Preferably, the sections of the central member are, in the substantially axial plane, provided with engagement elements preventing displacement of the sections in relation to each other in the longitudinal direction of the plane. Thereby the engagement elements may be constituted by complementary pins and cavities and/or complementary keys and grooves extending in the axial direction of the central member. The sections of the central member can be identical so that they can be manufactured in the same molding tool, the sections being rotated 180° in relation to each other when being connected to each other.

The invention is described more in detail in the following with reference to the accompanying drawings; wherein

DETAILED DESCRIPTION OF THE PREFERRED EMBODIMENTS

Figure 1A:
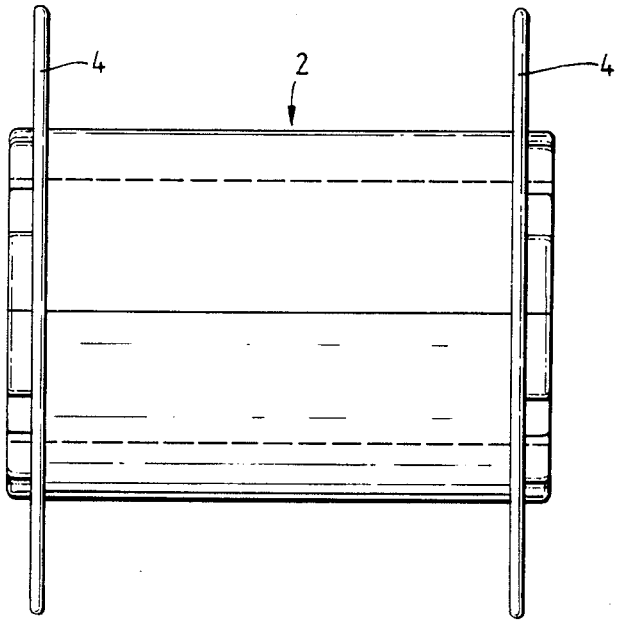
FIGS. 1*a* and 1*b* are a side view and an end view, respectively, of an embodiment of a spool according to the present invention.

The main structural members of the spool according to the present invention are a central member 2 and two end flanges 4.

The central member 2 is tubular and forms a cylindrical outer surface. Preferably the central member is manufactured from cellular plastic. The central member 2 is divided in a diametrical plane and forms two sections 6 having semi-circular cross sectional shape. Thus, the sections 6 contact each other in the diametrical plane and are here provided with engagement members preventing displacement of the sections in relation to each other in the direction of the diametrical plane. The engagement members are constituted by complementary pins 8 and cavities 10 and by complementary keys 12 and grooves 14. The engagement members are provided so that the two sections 6 are identical and can be manufactured in the same mold.

At its end portions the central member 2 is provided with peripheral grooves 16. The bottoms of the grooves 16 form axially oriented surface portions 18, while the lateral walls of the grooves form radially oriented surface portions 20 and 22. In the direction of the ends of the central member 2 the peripheral grooves 16 are restricted by radially outwardly directed lugs 24, thus forming the radially oriented surface portions 22. The radially outwardly directed lugs 24 are four in number in the embodiment shown and form gaps 26 between themselves.

The axially directed surface portions 18 forming the bottoms of the peripheral grooves 16 deviate somewhat from the circular shape in the respect that within the areas of the radially outwardly directed lugs 24 the surface portions 18 are formed with low projections 28 forming depressions 30 between themselves.

The end flanges 4 are of annular shape and are preferably manufactured from corrugated cardboard having a thickness corresponding to the width of the peripheral grooves 16 of the central member 2, for example a width of 10 mm.

At their inner periphery the annular end flanges 4 have inwardly directed lugs 32 having a number and a shape corresponding to the gaps 26 between the radially inwardly directed lugs 24 at the end portions of the central member 2.

Figure 1B:
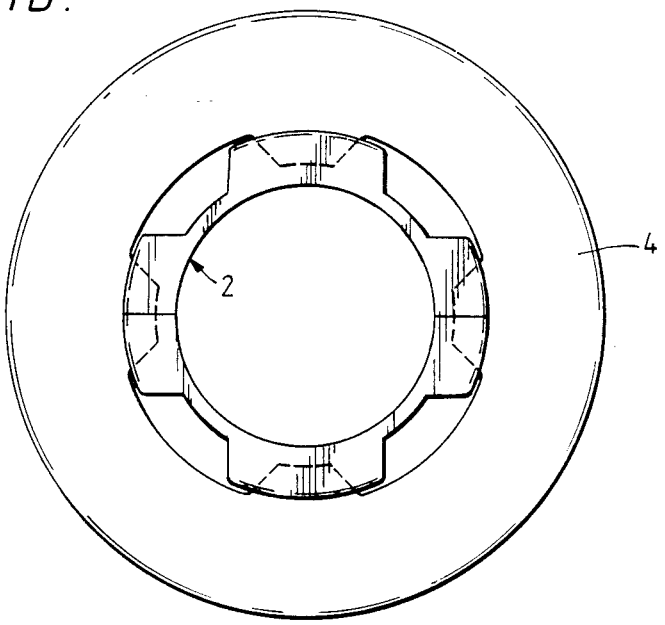
Figure 2A:
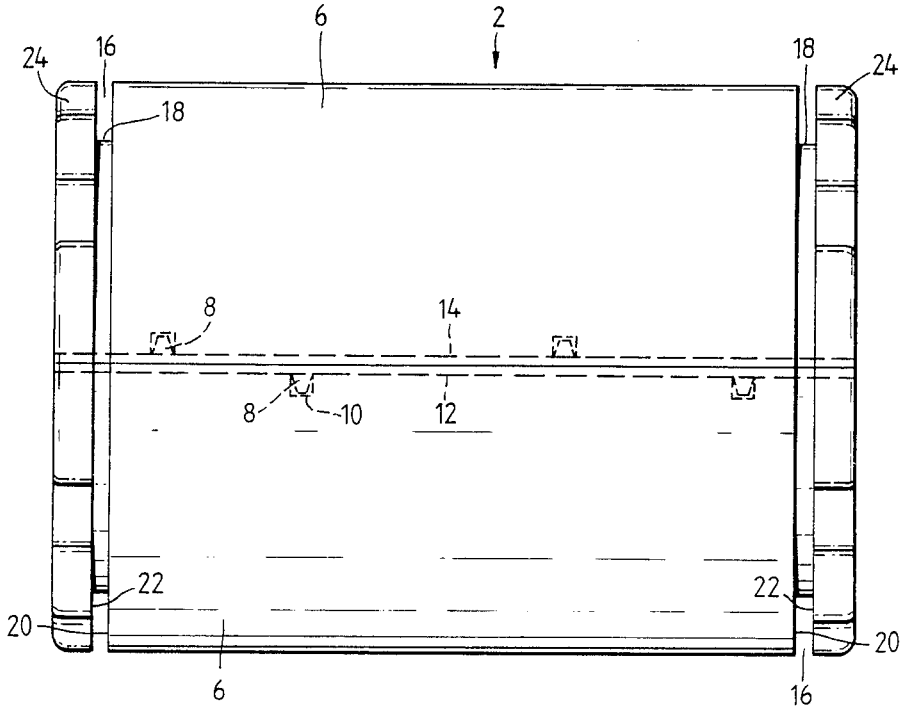
FIGS. 2*a* and 2*b* are a side view and an end view, respectively, of a central member of the spool shown in FIGS. 1*a* and 1*b*.
Figure 2B:
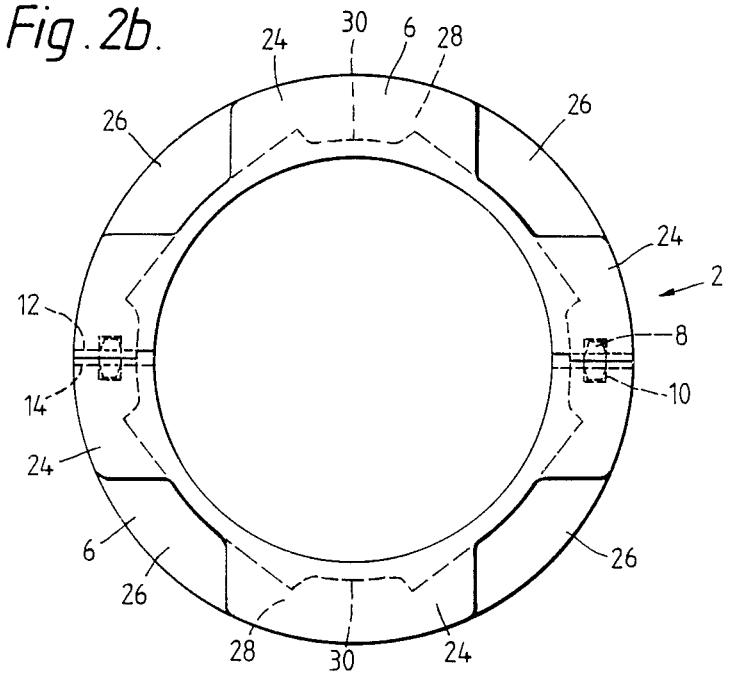
Figure 3:
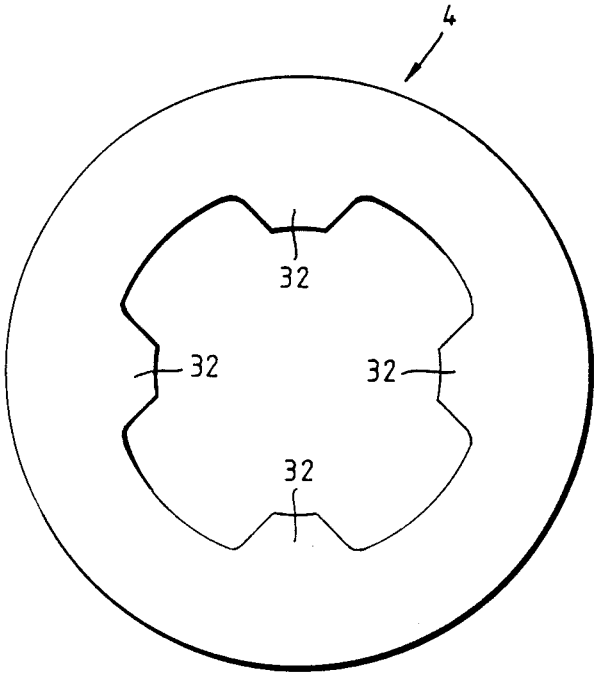
FIG. 3 is an elevational view of an end flange of the spool shown in FIGS. 1*a* and 1*b*.

In the mounted position of the spool shown in FIGS. 1*a* and 1*b* the lugs 32 of the end flanges 4 engage one groove 16 each of the end portions of the central member 2 behind one of the radially outwardly directed lugs 24 each. Thus, the lugs 32 engage the radially inwardly directed surface portions 18 as well as the axially directed surface portions 20 and 22 which means that the end flanges 4 are fixed in relation to the central member 2 in a position in which the end flanges enclose and keep together the sections of the central member. The inner edges of the lugs 32 engage the depressions 30 at the bottom of the groove 16 providing a releasable locking of the end flanges 4 in relation to the central member 2 in the position shown in FIGS. 1*a* and 1*b*.

The spool according to the invention can be disassembled by rotating the end flanges 4 in relation to the central member 2 to the position in which the lugs 22 of the end flanges are positioned opposite to the gaps 26 between the lugs 24 of the central member, the projections 28 being thereby elastically deformed by the inner edge surfaces of the lugs of the end flanges. In this position the end flanges 4 can be displaced axially away from the central member 2 whereupon it is possible to separate the two sections 6 of the central member 2 by disengaging the engagement members 8, 10, 12 and 14.

In its disassembled conditions the spool can be stored and transported in a space-saving way by the fact that the end flanges can be positioned flat against each other and the sections of the central member can be positioned partly inside each other.

It is realized that the spool can be assembled in a simple manner by the fact that the sections of the central member are connected with each other and the end flanges are positioned so that they enclose and keep the sections of the central member together.

The invention can be modified within the scope of the following claims.

What is claimed is:

1. A knock down spool comprising:

a substantially cylindrical central member comprising a cellular plastic and including at least two sections releasably connected with each other in a substantially axially extending plane;

radially outwardly directed lugs extending along portions of the periphery of said central member and forming gaps between said lugs;

a pair of grooves provided in said central member, one groove at each opposite end portion of said central member, said grooves providing axially and radially oriented surface portions, said grooves extending in the direction of the ends of said central member restricted by said outwardly directed lugs;

a pair of radially projecting end flanges releasably inserted each onto one end portion of said central member for holding said at least two sections of said central member in a connected position;

radially inwardly directed lugs provided on said end flanges, said inwardly directed lugs being insertable into said grooves through the gaps between the radially outwardly directed lugs of said central member and being introduceable behind said radially outwardly directed lugs by rotating the end flanges in relation to said central member;

a plurality of deformable locking means formed in the bottoms of said grooves within the areas of the radially outwardly directed lugs, each of said deformable locking means cooperating with corresponding locking means formed at the radially, inwardly directed lugs of the end flanges for providing a releasable locking of the end flanges in a correct rotational position in which the lugs of the end flanges are positioned behind the lugs of said central member.

2. A spool as claimed in claim 1, wherein said central member is tubular and consists of two sections connected with each other in a diametrical plane of the central member.

3. A spool as claimed in claim 1, wherein said flanges consist of cardboard or paper material, preferably corrugated cardboard.

4. A spool as claimed in claim 1, wherein said deformable locking means of said grooves comprise a plurality of projections alternating with a plurality of depressions formed in the bottoms of said grooves, each of said depressions being adapted to receive one end portion of said inwardly directed lugs of the end flanges defining said corresponding locking means.

5. A spool as claimed in claim 4, wherein said flanges consist of cardboard or paper material, preferably corrugated cardboard.

6. A spool as claimed in claim 4, wherein said at least two sections of the central member are in the substantially axial plane provided with engagement members such as to prevent displacement of said sections of the central member in relation to each other in the direction of the plane.

7. A spool as claimed in claim 6, wherein said engagement members are constituted by complementary pins and cavities and complementary keys and grooves extending in the axial direction ot the central member.

8. A spool as claimed in claim 6, wherein said engagement members are constituted by complementary keys and grooves extending in the axial direction of the central member.

9. A spool as claimed in claim 6, wherein said engagement members are constituted by complementary pins and cavities extending in the axial direction of the central member.

10. A spool as claimed in claim 1, wherein said at least two sections of the central member are in the substantially axial plane provided with engagement members such as to prevent displacement of said sections of the central member in relation to each other in the direction of the plane.

11. A spool as claimed in claim 10, wherein said engagement members are constituted by complementary pins and cavities extending in the axial direction of the central member.

12. A spool as claimed in claim 10, wherein said engagement members are constituted by complementary pins and cavities and complementary keys and grooves extending in the axial direction of the central member.

13. A spool as claimed in claim 10, wherein said engagement members are constituted by complementary keys and grooves extending in the axial direction of the central member.

* * * * *